US009309752B2

(12) United States Patent
Talley et al.

(10) Patent No.: US 9,309,752 B2
(45) Date of Patent: Apr. 12, 2016

(54) COMPLETING LONG, DEVIATED WELLS

(75) Inventors: Clifford Lynn Talley, Midland, TX (US); Ramon Eduardo Melean, Midland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/395,025

(22) PCT Filed: Apr. 25, 2012

(86) PCT No.: PCT/US2012/034966

§ 371 (c)(1), (2), (4) Date: Oct. 16, 2014

(87) PCT Pub. No.: WO2013/158124

PCT Pub. Date: Oct. 24, 2013

(65) Prior Publication Data

US 2015/0107843 A1 Apr. 23, 2015

Related U.S. Application Data

(60) Provisional application No. 61/624,761, filed on Apr. 16, 2012.

(51) Int. Cl.

| | |
|---|---|
| ***E21B 43/10*** | (2006.01) |
| ***E21B 34/08*** | (2006.01) |
| ***E21B 33/134*** | (2006.01) |
| ***E21B 43/26*** | (2006.01) |

(52) U.S. Cl.

CPC ..... *E21B 43/10* (2013.01); *E21B 33/134* (2013.01); *E21B 34/08* (2013.01); *E21B 43/26* (2013.01)

(58) Field of Classification Search

CPC ..... E21B 43/10

See application file for complete search history.

(56) References Cited

U.S. PATENT DOCUMENTS

| | | | | |
|---|---|---|---|---|
| 3,526,280 | A | 9/1970 | Aulick | |
| 3,572,432 | A * | 3/1971 | Aulick | E21B 33/14 166/114 |
| 4,384,616 | A | 5/1983 | Dellinger | |
| 5,181,571 | A * | 1/1993 | Mueller et al. | 166/381 |
| 5,492,173 | A * | 2/1996 | Kilgore et al. | 166/66.4 |
| 6,505,685 | B1 * | 1/2003 | Sullaway et al. | 166/386 |

(Continued)

FOREIGN PATENT DOCUMENTS

EP 0846839 4/2003

OTHER PUBLICATIONS

International Search Report/Written Opinion Issued Apr. 29, 2013 by Korean Commissioner, 12 pgs.

(Continued)

*Primary Examiner* — Robert E Fuller
*Assistant Examiner* — Steven MacDonald
(74) *Attorney, Agent, or Firm* — Scott Richardson; Fish & Richardson P.C.

(57) ABSTRACT

A buoyancy fluid is sealed in an interior central bore of a completion liner with a plug assembly in the interior central bore. The buoyancy fluid has a lower density than the fluid contained in the wellbore. The buoyancy fluid reduces the force, and thus friction, at the interface between the liner and the bottom of the wellbore while the completion liner is being run to final depth. When the buoyancy fluid is no longer needed, the plug assembly can be withdrawn uphole from the completion liner and to the surface.

16 Claims, 3 Drawing Sheets

(56) References Cited

U.S. PATENT DOCUMENTS

| | | | | |
|---|---|---|---|---|
| 7,267,176 | B2 | 9/2007 | Madden | |
| 7,789,162 | B2 | 9/2010 | Keller | |
| 2003/0116324 | A1 | 6/2003 | Dawson et al. | |
| 2005/0150693 | A1 | 7/2005 | Madden | |
| 2007/0102164 | A1* | 5/2007 | Mackenzie | 166/386 |
| 2007/0295513 | A1* | 12/2007 | Biegler et al. | 166/381 |
| 2008/0115942 | A1 | 5/2008 | Keller | |
| 2008/0308282 | A1* | 12/2008 | Standridge et al. | 166/387 |
| 2011/0114320 | A1 | 5/2011 | Sponchia et al. | |

OTHER PUBLICATIONS

SPE 149206, Rogers, et al., SPE Eastern Regional Meeting Columbus Ohio, Aug. 17-19, 2011, 10 pgs.

Halliburton Buoyancy Assisted Casing Equipment Assembly (BACE) H02348R 05/06 www.halliburton.com copyright 2006, 2 pgs.

Halliburton Subsurface Safety Equipment, published Jul. 2011, 35 pgs.

Halliburton Evo-Trieve Bridge Plug, published Dec. 2011, 2 pgs.

Authorized Officer Simin Baharlou, PCT International Preliminary Report on Patentability, PCT/US2012/034966, Oct. 30, 2014, 8 pages.

Patent Examination Report No. 1, Australian Application No. 2012377369, Jul. 29, 2015, 4 pages.

Extended European Search Report, European Application No. 12874773.0, Aug. 20, 2015, 7 pages.

Canadian Office Action, Canadian Application No. 2,870,514, Oct. 26, 2015, 4 pages.

* cited by examiner

COMPLETING LONG, DEVIATED WELLS

CROSS-REFERENCE TO RELATED APPLICATION

This application claims priority under 35 U.S.C. §119 to U.S. Provisional Patent Application Ser. No. 61/624,761, filed Apr. 16, 2012, which is herein incorporated by reference in its entirety.

BACKGROUND

The desired length of deviated or horizontal sections in well systems is getting longer and longer as operators are trying to reach more of a given subterranean zone with a single well. The longer length presents more friction, and thus presents problems in getting the completion liner to the toe of the wellbore because the maximum frictional force in driving the liner from the surface to the final depth can be greater than the force available to drive the liner to final depth.

DESCRIPTION OF DRAWINGS

Like reference symbols in the various drawings indicate like elements.

DETAILED DESCRIPTION

Figure 1:
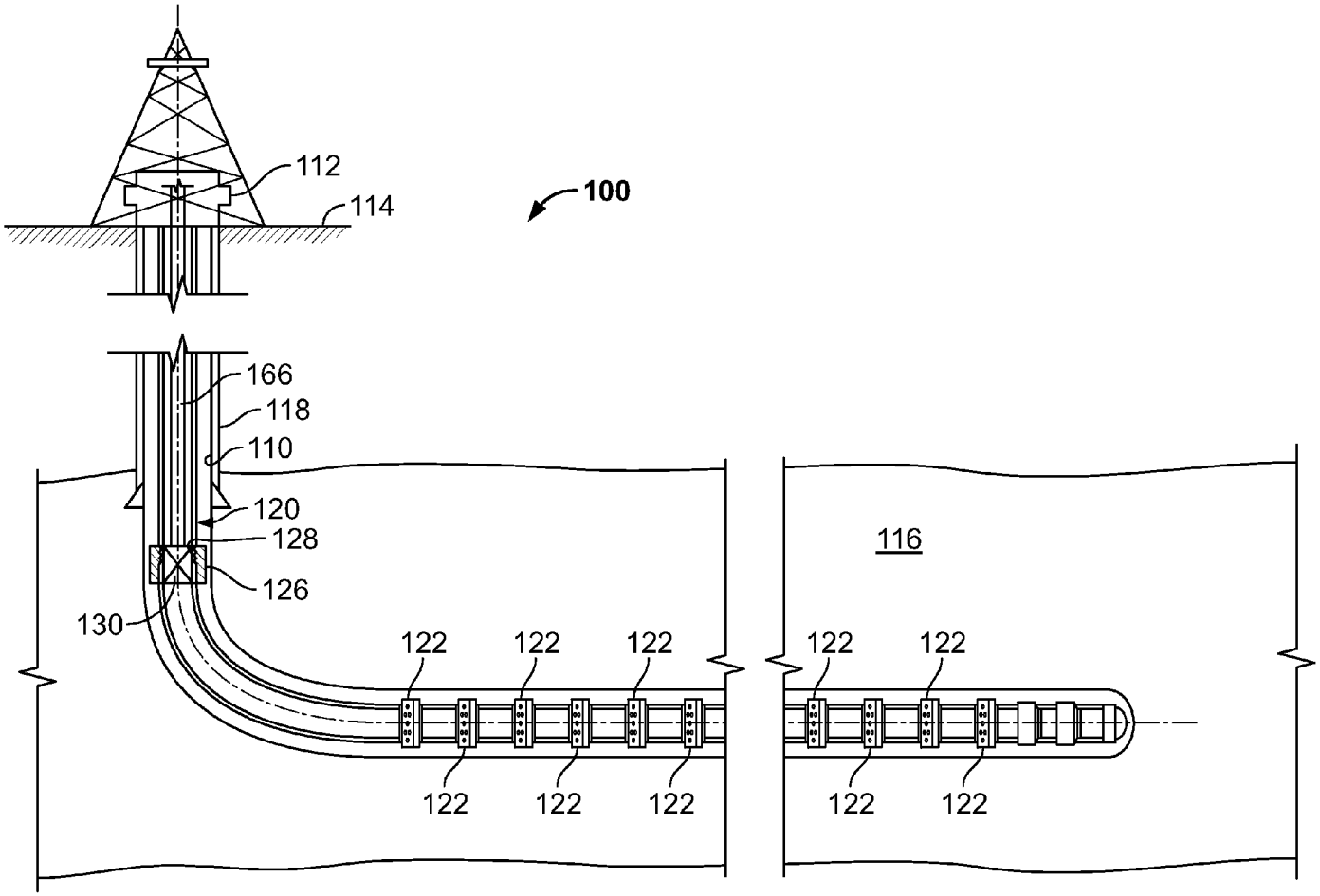
FIG. 1 is a schematic side cross sectional view of an example well system.

FIG. 1 shows an example well system 100 constructed in accordance with the concepts described herein. The well system 100 includes a substantially cylindrical wellbore 110 that extends from a wellhead 112 at the terranean surface 114, downward into the Earth, into one or more subterranean zones 116 (one shown). The depicted wellbore 110 is a non-vertical deviating wellbore and particularly a horizontal wellbore, having a substantially vertical portion that extends from the surface 114 to the subterranean zone 116 and a substantially horizontal portion in the subterranean zone 116. Although discussed herein in connection with a horizontally deviated wellbore 110, the concepts herein are applicable to other configurations of wellbores 110. Some examples include multilaterals, wellbores that deviate to a slant, wellbores that undulate and/or other configurations.

A portion of the wellbore 110 extending from the wellhead 112 to the subterranean zone 116 is lined with lengths of tubing called casing 118. In constructing the well system 100, the wellbore 110 is drilled in sections. When a section is drilled, a length of the casing 118 is installed in the section. Then, the next section of the wellbore 110 is drilled and another section of the casing 118 is installed in the newly drilled section. Sections of the wellbore 110 are drilled and cased in sections until the wellbore 110 and casing 118 reach the subterranean zone 116. Then, the horizontal portion of the wellbore 110 is drilled, substantially continuously, to the termination point of the wellbore 110. In certain instances, the horizontal or deviated portion of the wellbore 110 can be 1 mile (1.6 km) long, 1.5 miles (2.4 km) long, 2 miles (3.2 km) long, or longer.

Upon completion of the wellbore 110, a tubular completion liner 120 is run into the wellbore 110 to a specified final depth where the completion liner 120 will remain after commissioning and during operation of the well system 100 in producing the subterranean zone 116. In certain instances, the specified depth is the toe of the wellbore 110 (i.e., the completion liner 120 is run until its end is at the toe of the wellbore 110). Then, the completion liner 120 is tied back to the casing 118 and/or to the wellhead 112 at the surface 114 with a packer and/or liner hanger. As the completion liner 120 is lowered into the horizontal portion of the wellbore 110, it contacts and bears on the bottom wall of the wellbore 110. Friction at the interface between the completion liner 120 and the bottom wall of the wellbore 110 resists movement of the completion liner 120 downhole towards the toe of the wellbore 110. Typically, the weight of the completion liner 120 in the vertical portion of the wellbore 110 alone or together with force applied by a rig at the surface 114 is enough to overcome the friction and drive the completion liner 120 to the specified final depth. However, in well systems 100 having long portions that deviate from vertical (e.g., horizontal, as in FIG. 1, or other slanted or undulating portions), the friction can be greater than the available force to drive the completion liner 120. The friction is exacerbated when the completion liner 120 includes components that have different outer diameters, producing an uneven exterior surface of the completion liner. For example, as discussed in more detail below, the completion liner 120 of FIG. 1 includes a plurality of frac window sleeves 122, each having a different outer diameter than the outer diameter of the remainder of the completion liner 120. In another example, the completion liner 120' of FIG. 2 includes not only the plurality of frac window sleeves 122, but also includes packers 164.

To facilitate running the completion liner 120 into the wellbore 110 when the friction exceeds the available force, the completion liner 120 of FIG. 1 includes provisions to cause the completion liner 120 to be buoyant in the fluids residing in the wellbore 110. Specifically, a buoyancy fluid having a lower density than the fluid in the wellbore 110 can be trapped in the completion liner 120. In certain instances, the fluid can be air trapped in the completion liner 120 as the liner is assembled. The resulting buoyancy reduces the force the completion liner 120 exerts against the bottom of the wellbore 110 or floats the completion liner 120 substantially out of contact with the bottom of the wellbore 110, thus reducing or eliminating the resulting friction.

To this end, the completion liner 120 of FIG. 1 is configured to receive a plug assembly 130. The plug assembly 130 seals with the interior surface of the completion liner 120, and creates a sealed interval in the internal central bore of the completion liner 120 below the plug assembly in which to contain the buoyancy fluid.

Figure 3A:
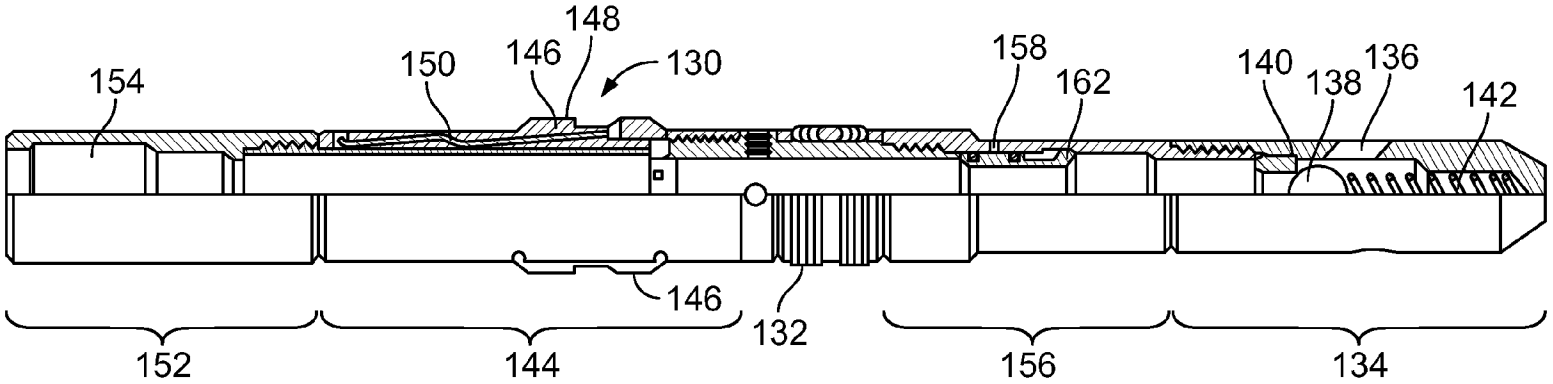
FIG. 3A is a quarter side cross sectional view of an example plug assembly.

FIG. 3A shows an example plug assembly 130 configured for use with the completion liner 120 of FIG. 1. The completion liner 120 of FIG. 1 includes a landing nipple 126 with an engagement profile 128 intermediate the ends of the completion liner 120. The landing nipple 126 is configured to receive and locate the plug assembly 130 at a specified location in the completion liner 120. The specified location can be selected based on the buoyancy needed to reduce the friction encountered in driving the completion liner 120 toward the toe of the wellbore 110 and the available force to do so. In certain instances, the specified location is near a heel of the horizontal or deviated portion of the wellbore 110. Although FIG. 1 shows only one landing nipple 126, the completion liner 120 can be configured with more than one landing nipple 126 to accommodate multiple plug assemblies. One example landing nipple that can be used as the landing nipple 126 is sold under the trademark Otis R landing nipple, a registered trademark of Halliburton Energy Services, Inc. Other examples exist.

The example plug assembly 130 is constructed from of multiple subassemblies coupled together (e.g., threateningly and/or otherwise). It includes one or more circumferential seals 132 around its exterior that are configured to form a seal (e.g., gas tight or otherwise) against the interior surface of the internal central bore of the completion liner 120.

A pressure relieving sub 134 of the plug assembly 130 has a port 136 between the interior central bore of the plug assembly 130 and an exterior of the plug assembly 130. The port 136 can be opened or closed by a closure 138 in the plug assembly 130. In the example of FIG. 3A, the closure 138 is in the form of a spherical ball held to seal against an uphole shoulder 140 by a spring 142. The closure 138 seals fluid in the exterior of the plug assembly 130, below the circumferential seals 132, from entering the interior central bore of the plug assembly 130 and passing uphole of the plug assembly 130. However, when a specified fluid pressure is applied uphole of the plug assembly 130, it pushes the closure 138 out of sealing engagement with the uphole shoulder 140 and compresses the spring 142. With the closure 138 out of sealing engagement with the shoulder 140, fluid can be communicated through the port 136 to the exterior of the plug assembly 130 downhole of the seals 132.

Figure 3B:
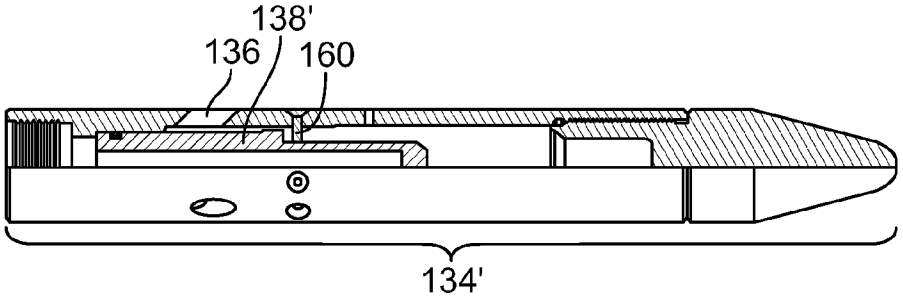
FIG. 3B is a quarter side cross sectional view of an alternate pressure relieving sub for use in the example plug assembly of FIG. 3A.

In other instances, the closure can take other forms. For example FIG. 3B shows an alternate pressure relieving sub 134' having a cylindrical piston shaped closure 138' held to cover and seal the port 135 by a shear pin 160. When pressure above the specify pressure is applied to the cylindrical piston shaped closure 138', the shear pin 160 is sheared, and the cylindrical piston shaped closure 138' allowed to shift downhole and uncover the port 136 to communicate fluid. In another example, the closure can take the form of a rupture disc over the port 136. When the specified pressure is exceeded, the rupture disc bursts and opens the port 136 to communicate fluid.

One example pressure relieving sub that can be used as the pressure relieving sub 134 is sold under the trademark Otis XR pump-through plug assembly, a registered trademark of Halliburton Energy Services, Inc. Another example pressure relieving sub that can be used as the pressure relieving sub 134 is a pump open plug sold by Halliburton Energy Services, Inc. Yet another example pressure relieving sub that can be used as the pressure relieving sub 134 is the Halliburton Storm Choke KX valve, where Storm Choke is a registered trademark of Halliburton Energy Services, Inc. Still other examples exist.

The plug assembly 130 can further include a lock mandrel sub 144 that has one or more dogs 146 (e.g., three dogs 146 arranged at 120° azimuth) each biased radially outward by a spring 150. The dogs 146 each have an exterior profile 148 configured to engage and grip the corresponding profile 128 of the landing nipple 126 (FIG. 1). When engaged and gripping the profile 128, the dogs 146 retain the plug assembly 130 relative to the landing nipple 126 until released. One example lock mandrel sub that can be used as the lock mandrel sub 144 is sold under the trademark Otis X and R lock mandrel, a registered trademark of Halliburton Energy Services, Inc.

The plug assembly 130 can further include a profile sub 152 that has an internal profile 154 configured to be engaged by a tool for pulling the plug assembly 130 from the wellbore 110. In certain instances, the profile sub 152 is a fishing neck and the profile 154 is configured to be engaged by a wireline or slickline fishing tool. In other instances, the internal profile 154 is configured to be engaged by fishing or pulling tool carried on a tubing string of coiled tubing and/or lengths of jointed tubing.

The plug assembly 130 can further include an equalizing sub 156 that has an equalizing port 158 and a sliding sealing sleeve 162. The sleeve 162 can be moved between sealing the equalizing port 158 and allowing communication of fluid pressure between the interior central bore of the plug assembly 130 and an exterior of the plug assembly 130 downhole of the seals 132. One example equalizing sub that can be used as the equalizing sub 156 is sold under the trademark Otis X and R equalizing sub, a registered trademark of Halliburton Energy Services, Inc.

Although discussed as being constructed from of multiple subassemblies coupled together, the example plug assembly 130 can be constructed as a single unit. Also, although the completion liner 120 is described above with a landing nipple 126, in other instances, the completion liner 120 can be provided without a landing nipple. For example, the plug assembly can be provided with slips, rather than dogs, that can be radially expanded to engage and grip a smooth interior surface of the completion liner 120. Since the slips do not engage a profile, such a plug assembly can be actuated to grip and seal the interior central bore of the completion liner 120 at any location along the length of the completion liner 120. In certain instances, the plug assembly with slips could be configured as a subsurface retrievable bridge plug. The bridge plug can be provided with a pressure relieving sub, such as one of the pressure relieving sub configurations described above, or without a pressure relieving sub. One example bridge plug that can be used as the plug assembly is sold under the trademark Evo-Trieve bridge plug, a registered trademark of Halliburton Energy Services, Inc.

In use, the plug assembly 130 is installed into the completion liner 120 at a specified location in the completion liner 120 while the completion liner 120 is at the surface. In instances where the completion liner 120 is provided with a landing nipple 126, the plug assembly 130 is installed into the landing nipple 126 while the completion liner 120 is at the surface. If the completion liner 120 has no landing nipple 126, the plug assembly can be installed at the specified location in the completion liner 120. In instances where the completion liner 120 is configured as jointed lengths of tubing and other components (e.g., sand screens, frac window sleeves, packers, and/or other components) assembled at the surface rig, a joint of the completion liner 120 with the plug assembly 130 installed can be added at the rig as the completion liner 120 is being assembled and run into the wellbore 110.

Once installed, the plug assembly 130 seals buoyancy fluid into the completion liner 120 below the plug assembly 130. The buoyancy fluid causes the completion liner 120 to be buoyant in the fluid in the wellbore 110, and reduces the force at the interface between the completion liner 120 and the bottom of the wellbore 110. The completion liner 120 is driven into the wellbore 110 by the weight of the completion liner 120 and/or additional force applied at the surface rig, until the completion liner 120 reaches the specified depth. If additional weight is needed to drive the completion liner 120 to the specified depth, additional fluid can be introduced into the interior bore of the completion liner 120 above the plug assembly 130. The plug assembly 130 will seal the additional fluid from flowing below the plug assembly 130, and the weight of the additional fluid will bear on the completion liner 120 and assist in driving the completion liner 120 the specified depth. Different fluids of different weight and different volumes of the fluid can be selected to achieve a specified force. For example, in certain instances, the additional fluid is drilling mud, water and/or another fluid. In certain instances, the additional fluid can have a density greater than the buoyancy fluid and/or the fluid in the wellbore 110.

Once the completion liner 120 is at the specified depth, the buoyancy can be reduced or eliminated by flooding the sealed interval of the completion liner 120 with another fluid having a density greater than the buoyancy fluid, for example, to cause the liner 120 cease to be buoyant in the well fluids. To flood the completion liner 120, the interior bore of the completion liner 120 above the plug assembly 130 is pressurized above the specified pressure that opens the closure 138. The fluid passes into the interior the completion liner 120 below the plug assembly 130 and displaces the buoyancy fluid. When pressure is equalized both uphole and downhole of the plug assembly 130, the plug assembly 130 can be removed from the completion liner 120 and withdrawn to the surface. The plug assembly 130 can be gripped and carried to the surface with a fishing tool on wireline or slickline 166 or with a fishing or pulling tool carried on tubing 168 (coiled and/or jointed). Thereafter, any additional installation steps to finish installation of the completion liner 120 are completed.

Figure 2:
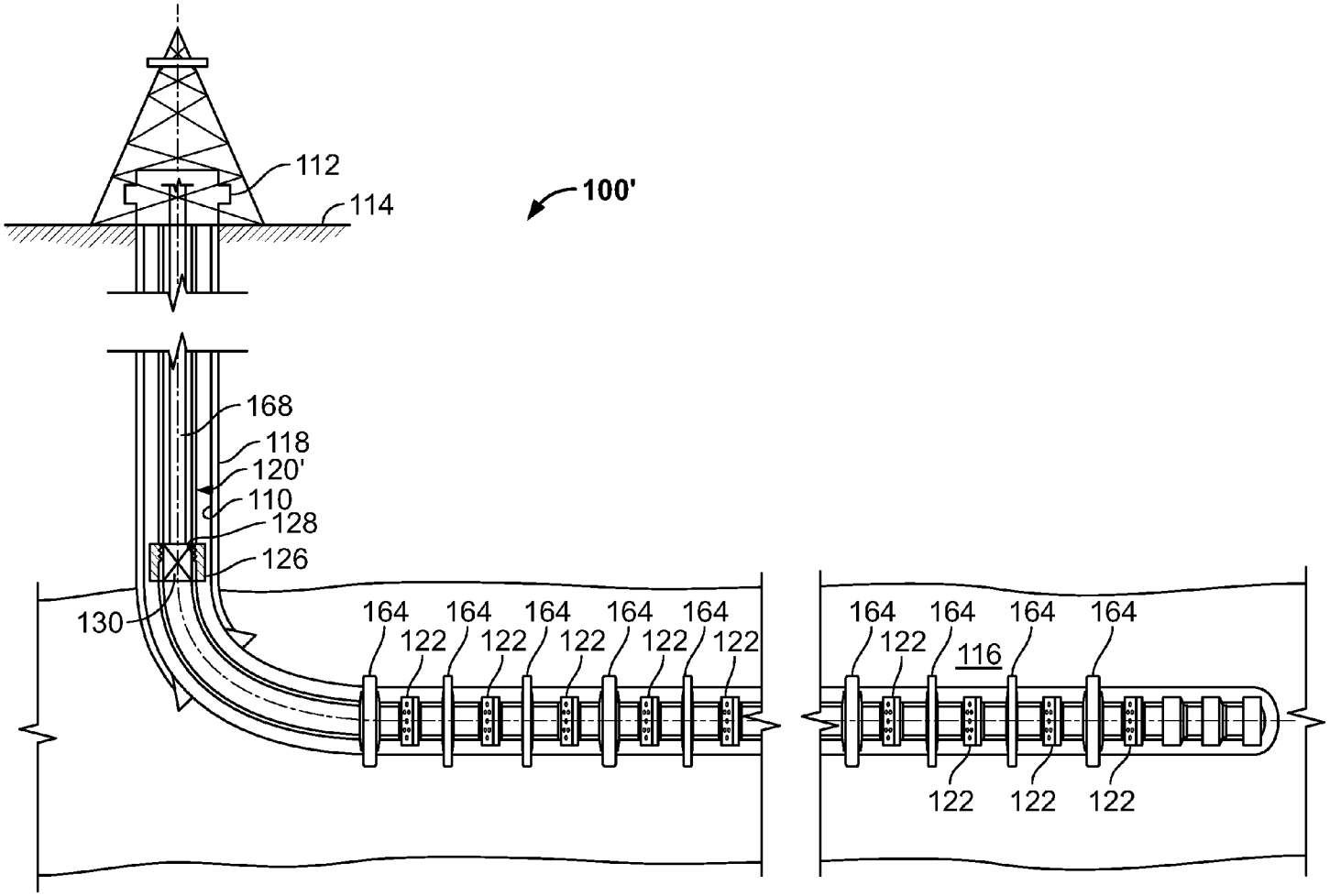
FIG. 2 is a schematic side cross sectional view of another example well system.

For example, the completion liner 120 of FIG. 1 is configured to cemented into the wellbore 110. Thus, cement is introduced into the annulus surrounding the completion liner 120. In another example, the configuration of FIG. 2 shows a completion liner 120' configured for an open hole completion. The completion liner 120' includes a plurality of spaced apart packers 164 that define a plurality of intervals around ones or groups of the window sleeves 122. In certain instances, the packers 164 are swell packers that swell to seal with the interior wall of the wellbore 110 when exposed to well fluids. Thus, rather than cementing the completion liner 120' into the wellbore, the completion liner 120 is run in and held in position while the packers 164 swell to seal with the wall of the wellbore 110. In yet still other configurations, the packers 164 can take the form of mechanical and/or hydraulic packers.

With the completion liner 120 in the wellbore 110, the subterranean zone 116 can then be subjected to a fracture treatment using the window sleeves 122. The window sleeves 122 can be individually operated to actuate ones or groups of the window sleeves 122 to open the sleeves 122 to communicate the interior of the completion liner 120 with the subterranean zone 116. Thus, one group of window sleeves 122 is opened, and frac fluid pumped into the completion liner 120 to fracture the subterranean zone 116 through the open group of window sleeves 122. Then, the next group of window sleeves 122 is opened, and the subterranean zone 116 fractured. The subterranean zone 116 is thus fractured in stages until the fracture treatment is complete.

In certain instances, the window sleeves 122 are of a type that are operated by dropping a ball through the interior central bore of the completion liner 120. To enable the subterranean zone 116 to be fractured in stages, the window sleeve 122 at the toe end of the completion liner 120 is sized to be actuated by the smallest ball dropped through the completion liner 120 and each window sleeve 122 uphole is sized to be actuated by a progressively larger ball. One example window sleeve that can be used as the window sleeve 122 are sold under the trademark RapidFrac sleeve and RapidStage sleeve, both registered trademarks of Halliburton Energy Services, Inc.

Window sleeves 122 of this configuration cannot readily accommodate a plug assembly that needs to travel downhole to the toe of the completion liner 120. However, because the plug assembly 130 described above can be withdrawn uphole to the surface, it does not interfere with nor does it need to be accommodated by such window sleeves 122 or other components downhole in the completion liner 120.

Notably, although discussed in connection with a completion liner 120 that contains window sleeves 122, the concepts herein could be applied to other configurations of completion liners, including those without window sleeves 122.

A number of variations have been described above. Nevertheless, it will be understood that still further modifications may be made. Accordingly, other embodiments are within the scope of the following claims.

What is claimed is:

1. A method of installing a liner into a fluid containing subterranean wellbore, the method comprising:

sealing a buoyancy fluid in an interior central bore of the liner with a plug assembly in the interior central bore by sealing the plug assembly to an interior surface of the liner while the plug assembly is at the terranean surface, the buoyancy fluid having a lower density than the fluid contained in the wellbore;

positioning the liner to a specified final depth in the wellbore;

withdrawing the plug assembly uphole; and after withdrawing the plug assembly uphole, flooding the liner with a fluid having a density greater than the buoyancy fluid.

2. The method of claim 1, where the buoyancy fluid comprises air.

3. The method of claim 1, where positioning the liner to a specified final depth in the wellbore comprises positioning the liner to the specified final depth in a portion of the wellbore that deviates from vertical.

4. The method of claim 3, where positioning the liner to the specified final depth in a portion of the wellbore that deviates from vertical comprises positioning the liner to the specified final depth in a horizontal portion of the wellbore.

5. The method of claim 1, where withdrawing the plug assembly comprises withdrawing the plug assembly uphole carried by a tubing or a wire.

6. The method of claim 1, further comprising, prior to positioning the liner to the specified final depth, depositing a second fluid into the interior central bore above the plug assembly, the second fluid having a higher density than the fluid contained in the wellbore.

7. The method of claim 1, where the buoyancy fluid sealed in the interior central bore of the liner causes the liner to be buoyant in the fluid contained in the wellbore and reduces the force at the interface between the liner and the bottom of the wellbore.

8. The method of claim 7, where the maximum frictional force in driving the liner from the terranean surface to the specified final depth without the buoyancy fluid sealed into the liner would be greater than the available force to drive the liner.

9. The method of claim 1, further comprising engaging the plug assembly to a profile on the interior central bore of the liner.

10. The method of claim 1, where the plug assembly comprises a bridge plug having slips.

11. The method of claim 1, where positioning the liner to a specified final depth in the wellbore comprises positioning the liner to a final depth of 1 mile (1.6 km) or deeper.

12. The method of claim 1, where the fluid having a density greater than the buoyancy fluid comprises drilling mud.

13. The method of claim 1, further comprising:

after flooding the liner with the fluid having a density greater than the buoyancy fluid, fixing the liner in place at the final depth in the wellbore by flowing a third fluid through the liner, and introducing a third fluid into an annulus surrounding the liner.

14. The method of claim 13, where the third fluid comprises a cement slurry.

15. A method of installing a liner into a fluid containing subterranean wellbore, the method comprising:

sealing a buoyancy fluid in an interior central bore of the liner with a plug assembly in the interior central bore by sealing the plug assembly to an interior surface of the liner while the plug assembly is at the terranean surface, the buoyancy fluid having a lower density than the fluid contained in the wellbore;

positioning the liner to a specified final depth in the wellbore;

prior to withdrawing the plug assembly, applying a specified pressure to an uphole side of the plug assembly to open a port through the plug assembly between a location uphole of the seal and a location downhole of the seal;

withdrawing the plug assembly uphole; and flooding the interior central bore of the liner downhole of the plug with a fluid having a density greater than the buoyancy fluid while displacing the buoyancy fluid from the interior central bore liner downhole of the plug.

16. A method of installing a liner into a fluid containing subterranean wellbore, the method comprising:

sealing a buoyancy fluid in an interior central bore of the liner with a plug assembly in the interior central bore by sealing the plug assembly to an interior surface of the liner while the plug assembly is at the terranean surface, the buoyancy fluid having a lower density than the fluid contained in the wellbore;

positioning the liner to a specified final depth in the wellbore;

withdrawing the plug assembly uphole;

where the liner comprises a plurality of frac window sleeves and the method further comprises after withdrawing the plug assembly uphole, operating the frac window sleeves and fracturing a subterranean zone around the wellbore.

* * * * *